US011357265B2

(12) United States Patent
Hanson Allen et al.

(10) Patent No.: US 11,357,265 B2
(45) Date of Patent: Jun. 14, 2022

(54) STRETCHABLE GUSSET

(71) Applicant: Spanx, LLC, Atlanta, GA (US)

(72) Inventors: Wendy Hanson Allen, Atlanta, GA (US); Deneb Torano, Atlanta, GA (US); Sylma Colon-Otten, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 0 days.

(21) Appl. No.: 15/964,516

(22) Filed: Apr. 27, 2018

(65) Prior Publication Data

US 2018/0310632 A1 Nov. 1, 2018

Related U.S. Application Data

(60) Provisional application No. 62/491,756, filed on Apr. 28, 2017.

(51) Int. Cl.
*A41B 9/00* (2006.01)
*A41B 9/08* (2006.01)

(52) U.S. Cl.
CPC ..... *A41B 9/005* (2013.01); *A41B 9/007* (2013.01); *A41B 9/08* (2013.01)

(58) Field of Classification Search
CPC ..... A41B 9/04; A41B 9/004; A41B 9/005; A41B 9/007; A41B 9/08; A41B 11/14; A41B 2300/332; A41B 2300/22; A41B 2400/44; A61F 13/496
See application file for complete search history.

(56) References Cited

U.S. PATENT DOCUMENTS 1,342,188 A * 6/1920 Stanley ..... A41B 9/08 2/78.1
1,469,287 A * 10/1923 Torchia ..... A41B 9/005 2/408
1,659,406 A * 2/1928 McCabe ..... A61F 5/03 450/103

(Continued)

OTHER PUBLICATIONS

La Perla: Shape Couture Forming Romper, http://www.nancymeyer.com/la-perla-shape-couture-forming-romper/paaaaagomfbpfhje/product, Accessed Apr. 25, 2017. Includes photograph of product gusset region on p. 2.

*Primary Examiner* — Sally Haden
(74) *Attorney, Agent, or Firm* — Meunier Carlin & Curfman LLC

(57) ABSTRACT

Some shapewear and other similar undergarments are equipped with an open gusset, which provides an opening at the crotch region to allow the wearer to use the restroom without removing any garments. A typical double gusset construction requires two hands to pull apart both layers in order to use the restroom, which can make using the restroom more difficult for the wearer. The stretchable gusset disclosed herein addresses the limitations of existing gusset constructions. The gusset panel is fixedly or seamlessly attached to the front body panel and fixedly or seamlessly attached to the back body panel. An access space is formed by leaving at least a portion of a lateral gusset panel edge unattached to any other portion of the garment. The access space can be widened with one hand due to the highly stretchable characteristics of the gusset panel.

23 Claims, 5 Drawing Sheets

(56) References Cited

U.S. PATENT DOCUMENTS 1,929,363 A * 10/1933 Long ..... A41B 9/04 2/406
1,973,963 A * 9/1934 Nishimoto ..... A41B 9/04 2/408
2,246,714 A * 6/1941 Blair ..... A41B 9/04 2/407
2,323,451 A * 7/1943 Bullinger ..... A41B 9/04 128/891
2,367,328 A * 1/1945 Bercaitz ..... A41B 9/04 450/103
2,437,830 A * 3/1948 McAllister ..... A41B 9/04 450/105
2,457,260 A * 12/1948 Morris ..... A41B 9/04 602/67
2,548,660 A * 4/1951 Feldman ..... A41B 13/04 2/408
2,651,048 A * 9/1953 Milberg ..... A41B 9/04 2/406
2,852,780 A * 9/1958 Gold ..... A41B 9/04 2/408
2,875,763 A * 3/1959 Marchisella ..... A41C 1/06 450/8
2,969,068 A * 1/1961 Murdock ..... A41B 9/04 450/100
3,020,556 A * 2/1962 Isley ..... A41B 11/14 2/409
3,022,788 A * 2/1962 Darcey ..... A41C 1/003 450/105
3,040,751 A * 6/1962 Mastenbrook ..... A41C 1/003 450/105
3,109,300 A * 11/1963 Garrou ..... A41B 9/04 66/177
3,109,301 A * 11/1963 Garrou ..... D04B 1/243 66/177
3,171,413 A * 3/1965 Jones ..... A41C 1/003 450/103
3,224,448 A * 12/1965 Diebold ..... A41C 1/003 450/105
3,449,932 A * 6/1969 Fillmore ..... A41B 11/14 66/177
3,590,823 A * 7/1971 Pope, Jr. ..... A41F 11/18 450/95
3,670,529 A * 6/1972 Fregeolle ..... D04B 15/18 66/177
3,739,398 A * 6/1973 Sarmiento ..... A41B 9/04 2/407
3,909,851 A * 10/1975 Garrou ..... A41B 11/14 2/409
3,974,836 A * 8/1976 Carlson ..... A41C 1/003 450/102
4,301,550 A * 11/1981 Carver ..... A41B 9/005 2/408
4,597,110 A * 7/1986 Smith, Sr ..... A41B 9/007 2/406
5,163,306 A * 11/1992 Boehm ..... D04B 1/106 66/177
5,533,212 A * 7/1996 Moretz ..... A41B 9/004 2/406
5,790,984 A * 8/1998 Doubleday ..... A41B 9/005 2/227
5,930,838 A * 8/1999 Carter-Scott-Pomije ..... A41D 1/06 2/79
6,324,699 B1 * 12/2001 Cosmah ..... A41B 11/14 2/239
6,964,065 B2 * 11/2005 Stevenson ..... A41B 9/004 2/400
7,100,214 B1 * 9/2006 Murray ..... A41C 1/003 2/406
7,553,303 B2 * 6/2009 Speak ..... A61F 13/505 2/408
9,003,571 B1 * 4/2015 Lewis-Williams ..... A41B 9/04 2/250
2012/0023646 A1 * 2/2012 Maxey ..... D04B 1/18 2/407
2012/0060264 A1 * 3/2012 Wilkins ..... A41B 9/04 2/406
2013/0042394 A1 * 2/2013 Wexler ..... A41B 9/14 2/400
2013/0104294 A1 * 5/2013 Edwards ..... A41B 9/04 2/408
2013/0212782 A1 * 8/2013 Black ..... A41B 9/00 2/406
2014/0273735 A1 * 9/2014 Cohen Larren ..... A41C 1/00 450/22
2018/0228665 A1 * 8/2018 Relekar ..... A61F 13/5611
2019/0320727 A1 * 10/2019 Bain ..... A41B 9/12

* cited by examiner

STRETCHABLE GUSSET

CROSS-REFERENCE TO RELATED APPLICATIONS

This application claims the benefit of U.S. Provisional Application 62/491,756, filed Apr. 28, 2017, which is incorporated by reference in its entirety for all purposes.

BACKGROUND

Certain types of apparel require specific undergarments. Undergarments can serve various purposes, such as shaping or compressing the body, providing decorative patterns, or incorporating a bra or other support for the breasts. Depending on the undergarment shape and compression level, some types of undergarments can be difficult to remove when the wearer needs to use a toilet. In certain cases, the wearer has to remove her outer garment in order to remove the undergarment. This is time-consuming and inconvenient for the wearer. It can be a challenge to design highly functional undergarments that also facilitate restroom use.

SUMMARY

An undergarment is disclosed herein that includes a stretchable gusset panel in the crotch region. The gusset panel extends between the front and back body panels and has high elongation and elasticity properties, allowing the wearer to stretch the gusset panel to the left or the right side using one hand. This maneuver widens an access space to facilitate using the restroom. The stretchable gusset panel is fixedly or seamlessly attached to the front body panel and fixedly or seamlessly attached to the back body panel. The access space is formed by leaving at least a portion of a lateral gusset panel edge unattached to any other portion of the garment.

The undergarment has a front body panel, a back body panel, and left and right leg portions seamlessly or fixedly attached to the front and back body panels. The garment also has a gusset panel seamlessly or fixedly attached to the front body panel and back body panel, extending between the front and back body panels through the crotch region of the undergarment. At least a portion of a lateral edge of the gusset panel is not attached to any part of the garment, at least partially defining an access space between the lateral gusset edge and either the left or the right leg portion. The gusset panel can be stretched to widen the access space. The undergarment may have a left and a right access space, the left access space defined by the left gusset edge and left leg portion, and the right access space defined by the right gusset edge and right leg portion. The gusset panel may be fixedly attached to the front body panel and back body panel by a seam, by bonding, or by other methods, or may be seamlessly attached.

In certain embodiments, the gusset panel is made from hosiery fabric or knit fabric. The gusset panel may be one layer of fabric, or two or more layers attached by a seam or by bonding. In certain embodiments, the gusset panel is wider at the back gusset panel edge than at the front gusset panel edge. The gusset panel may have an elongation of from about 100% to about 700% at 100 N load in the length direction, the width direction, or both directions.

In certain embodiments, the undergarment also has a left side cover panel and a right side cover panel that extend between the front and back body panels through the crotch region of the garment. The left side cover panel has a left inside access edge and the right side cover panel has a right inside access edge, and the left and right inside access edge define an access space. The left and right side cover panels may be fixedly or seamlessly attached to the front and back body panels. In certain embodiments, the left side cover panel has a left front cover panel edge and a left back cover panel edge, which are attached to the front body panel lower edge and the back body panel lower edge. The right side cover panel has a right front cover panel edge and a right back cover panel edge, which are also attached to the front body panel lower edge and the back body panel lower edge.

In certain embodiments, the gusset panel, the left side cover panel, and the right side cover panel are fixedly attached to the front and back body panels by at least one seam. The seam can be an overlock stitch. A single seam can be used to attach the gusset panel, the left side cover panel, and the right side cover panel to the front and back body panels. In certain embodiments, the gusset panel, the left side cover panel, and the right side cover panel are fixedly attached to the front and back body panels by bonding. In certain embodiments, the gusset panel, the left side cover panel, and the right side cover panel are seamlessly attached to the front and back body panels. In certain embodiments, the gusset panel is located to the exterior of the right and left side cover panels and may at least partially overlap the left and right side cover panels. In certain embodiments, the left and right side cover panels are located to the exterior of the gusset panel, and the left and right side cover panels may at least partially overlap the gusset panel.

Methods of making an undergarment having a gusset panel are also disclosed herein. Methods of making the undergarment can include the steps of forming a front body panel, a back body panel, and a left and right leg portion. A front edge of a gusset panel is fixedly attached to a lower edge of a front body panel, and a back edge of the gusset panel is fixedly attached to a lower edge of a back body panel. At least a portion of a lateral gusset panel edge is left unattached to any part of the garment. In certain embodiments, methods of making an undergarment include seamlessly attaching a gusset panel to a front body panel and a back body panel, and seamlessly attaching left and right leg portions to the front and back body panels. At least a portion of a lateral gusset panel edge is left unattached to any part of the garment.

The method can further include fixedly attaching a left side cover panel to the front body panel, the back body panel, and the left leg portion such that the left side cover panel is overlapped by the left lateral gusset panel edge, and fixedly attaching a right side cover panel to the front body panel, the back body panel, and the right leg portion such that the right side cover panel is overlapped by the right lateral gusset panel edge. For example, a continuous seam can be used to fixedly attach the left side cover panel, the right side cover panel, the front gusset panel edge, and the back gusset panel edge. The continuous seam can extend around the cover panels as described above (i.e., it can attach the garment to the left front cover panel edge, the left outside cover panel edge, the left back cover panel edge, the right back cover panel edge, the right outside cover panel edge, and the right front cover panel edge). The same continuous seam can be used to attach the front gusset panel edge to the front body panel lower edge, the left front cover panel edge, and the right front cover panel edge, and to attach the back gusset panel edge to the back

DETAILED DESCRIPTION

Figure 1:
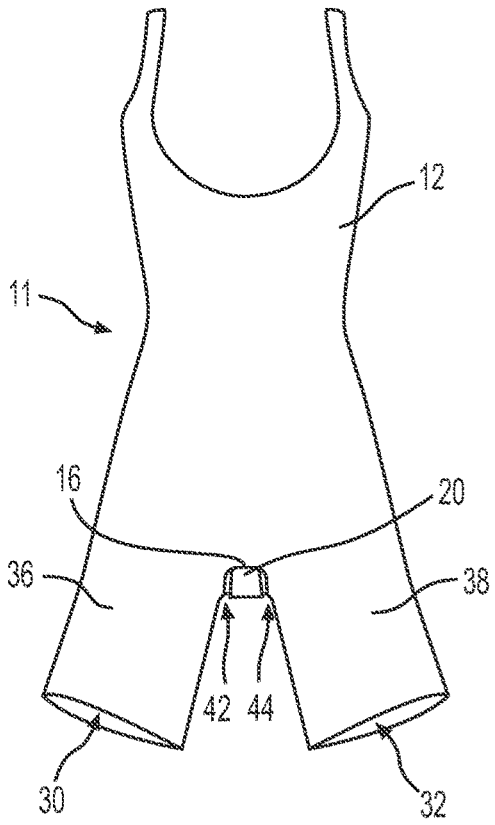
FIG. 1 is a front view of a garment having a stretchable gusset panel.

To address the issue of using the restroom, some shapewear and other similar undergarments are equipped with an open gusset, which provides an opening at the crotch region to allow the wearer to use the restroom without removing any undergarments. Typical constructions of open gussets include an opening of various shapes or sizes, double gussets, or a detachable gusset opening. Open gussets leave a hole at the crotch region. This allows a wearer to easily use the restroom, but does not provide modesty. It is also uncomfortable for many users. Double gussets have two overlapping layers of fabric that cover the crotch region during normal wear. The double gusset construction provides more modesty than the open gusset, but not complete modesty depending on the wearer's position. Further, the double gusset construction requires two hands to pull apart both layers in order to use the restroom, which can make using the restroom more difficult for the wearer by, for example, leaving no hands free to hold up the dress or other garment being worn over the undergarment. The stretchable gusset disclosed herein addresses the limitations of existing gusset constructions.

An undergarment is described herein that includes a gusset panel in the crotch region. The gusset panel extends between the front and back body panels and has high elongation and elasticity properties, allowing the wearer to move the gusset panel to the left or the right side using one hand. This maneuver widens an access space to facilitate using the restroom. The gusset panel is fixedly or seamlessly attached to the front body panel and fixedly or seamlessly attached to the back body panel. The access space is formed by leaving at least a portion of a lateral gusset panel edge unattached to any other portion of the garment.

This description may refer to certain aspects of a garment relative to other aspects of the garment or to the body of a wearer. Upward, upper, or uppermost indicates a superior direction, or toward a wearer's head. Downward and lower or lower most indicates an inferior direction, or toward a wearer's feet. The terms right and left are in reference to the wearer's body. Lateral indicates a direction toward the wearer's sides, whereas medial indicates a direction toward the wearer's center. Exterior refers to farther from the wearer's body, whereas interior and underneath refer to closer to the wearer's body.

As used herein, fixedly attached is defined as attached via sewing or bonding. Seamlessly attached is defined as continuously formed as one stretch of fabric. Seamless attachment can be achieved by knitting two or more portions or panels of the undergarment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric.

Figure 2:
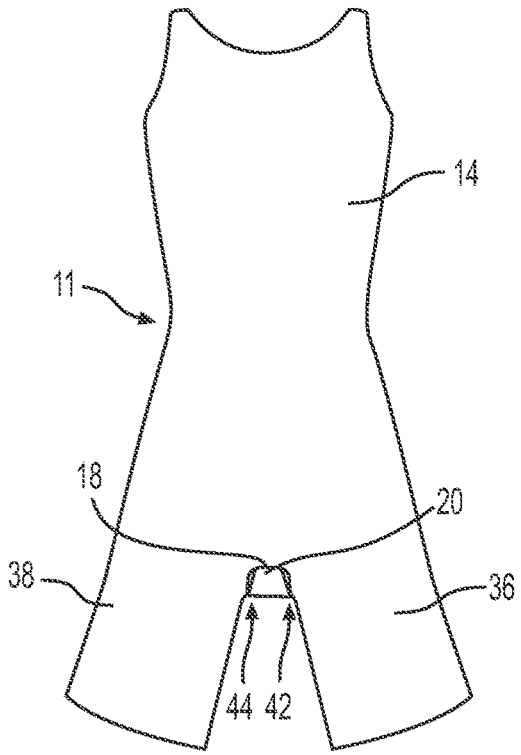
FIG. 2 is a back view of the garment embodiment of FIG. 1.

FIG. 1 and FIG. 2 illustrate front and back views of a garment having a stretchable gusset panel 20. The garment 10 includes a front body panel 12, a back body panel 14, a right leg portion 36 and a left leg portion 38. Each leg portion is attached to the front body panel 12 and the back body panel 14. The right leg portion 36 encircles the right leg space 30, and the left leg portion 38 encircles the left leg space 32. In certain embodiments, the front body panel 12, the back body panel 14, the right leg portion 36 and the left leg portion 38 are separate pieces of fabric and are attached with a seam, bonding, or other attachment method known in the art. In other embodiments, the front body panel 12, the back body panel 14, the right leg portion 36 and the left leg portion 38 are formed continuously from the same piece of fabric. In certain embodiments, the right leg portion 36 and the left leg portion 38 are formed continuously with the front body panel 12 and/or the back body panel 14, as shown in FIG. 1 and FIG. 2. In other embodiments, the right leg portion 36 and the left leg portion 38 are attached to the front body panel 12 and the back body panel 14 by a seam, by bonding, or by other methods of joining fabric known in the art. In some embodiments, the front body panel 12 may be formed of multiple separate pieces of fabric attached with a seam or other attachment method (for example, a seam extending up the center of the front side of the garment). In some embodiments, the back body panel 14 may be formed of multiple separate pieces of fabric attached with a seam or other attachment method (for example, a seam extending up the center of the back side of the garment). The front body panel 12 and back body panel 14 can comprise any fabric known in the art for use in shapewear or other undergarments.

Figure 3:
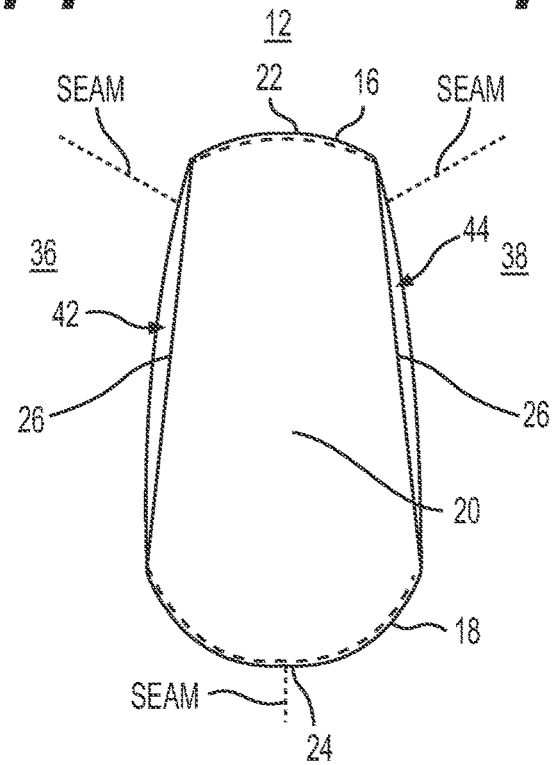
FIG. 3 is an exterior (bottom up) view of the gusset panel of the undergarment embodiment of FIGS. 1 and 2.

The undergarments disclosed herein include a gusset panel 20 located in a crotch region of the undergarment. The gusset panel 20 can be a separate piece of material than the front or back body panels 12, 14. It can be joined to one or both of the front and/or back body panels 12, 14 by a seam or bonding. FIG. 3 illustrates an exterior view of a gusset panel 20. The gusset panel 20 has a front gusset panel edge 22, a back gusset panel edge 24, and two lateral gusset panel edges 26 extending between the front gusset panel edge 22 and the back gusset panel edge 24. At least a portion of each of the two lateral gusset panel edges 26 are not attached to the front body panel 12 or back body panel 14. In some embodiments, at least a portion of the two lateral gusset panel edges 26 are unattached to any other portion of the garment. By contrast, the front gusset panel edge 22 is attached along the lower edge 16 of the front body panel, and the back gusset panel edge 24 is attached along the lower edge 18 of the back body panel (the dotted lines along the front gusset panel edge 22 and back gusset panel edge 24 illustrate where the gusset panel is attached to the garment). In certain embodiments, the gusset panel 20 is continuously knitted to one or both of the front body panel 12 and the back body panel 14.

One or more access spaces 42, 44 are located in the crotch portion, allowing the wearer to stretch the gusset panel 20 aside removing the garment. In the example embodiment shown in FIGS. 1-3, the right leg portion 36 and one lateral gusset panel edge 26 define a first access space 42, and the left leg portion 38 and a second lateral gusset panel edge 26 define a second access space 44. In some embodiments, one of the lateral gusset panel edges can be attached to a leg portion, while the other lateral gusset panel edge remains unattached, forming a single access space. The dotted lines extending from the right access space 42 and left access space 44 illustrate a seam in the leg portions. This is to give context to the figure and is not intended to limit the invention.

The gusset panel 20 is not intended to be limited to any particular shape. In certain embodiments, the gusset panel is generally rectangular in shape, with linear front and back gusset panel edges 22, 24 that are equal in length. In other embodiments, such as the one shown in FIG. 3, the front gusset panel edge 22 and/or back gusset panel edge 24 may be curved, and the back gusset panel edge may be wider than the front gusset panel edge. As used herein, the width indicates a direction from left to right across the gusset panel 20. The length indicates a direction from front to back across the gusset panel 20. In certain embodiments, the gusset panel is one layer of fabric. In other embodiments, the gusset panel is two or more layers of fabric. The two or more layers of fabric can be attached by a seam, by bonding, or by other methods known in the art for joining more than one layer of fabric.

Figure 4:
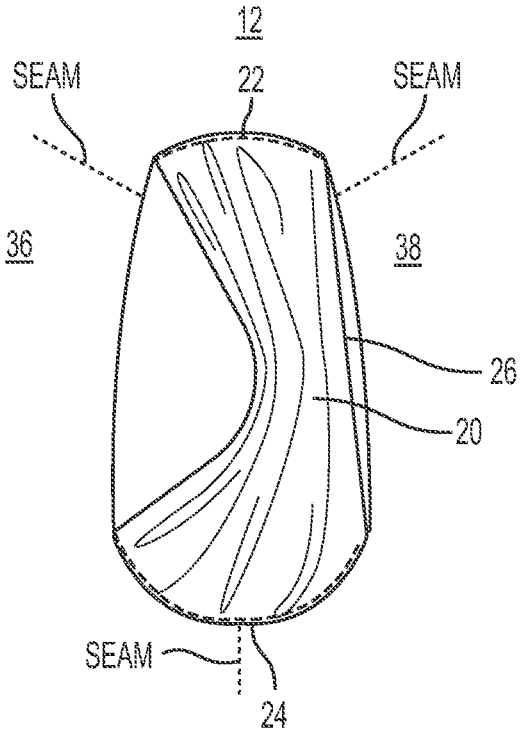
FIG. 4 is an exterior view of a gusset panel stretched to one side.

The gusset panels disclosed herein are formed of stretchable fabrics so that they can be stretched to the side, as shown in FIG. 4. The fabric of the gusset panel 20 has high elongation properties, such that it generally lays flat against the body of the wearer, but is also able to be stretched to the side. In some embodiments, the gusset panel 20 has a higher elasticity than the front body panel 12 and/or the back body panel 14. The tension force of the fabric can be determined by test method ASTM D4964-1996(2008), Tensile Testing Machine, Constant Rate of Extension. A loop specimen of 250 millimeters in loop length is placed around the clamps of a testing machine. The machine speed is 500 millimeters/minute. The specimen is cycled three times from zero to 100 Newton (N) load. During the third extension-load cycle, the percent elongation is measured, as is the tension force at 30%, 50%, and 70% elongation. In certain embodiments, the gusset panel fabric has a tension force in the length direction of from about 0 N to about 0.4 N at 30% elongation, from about 0.2 N to about 3 N at 50% elongation, and from about 1 N to about 6 N at 70% elongation. In certain embodiments, the gusset panel fabric has a tension force in the width direction of from about 0 N to about 0.4 N at 30% elongation, from about 0.2 N to about 3 N at 50% elongation, and from about 1 N to about 6 N at 70% elongation. In certain embodiments, the gusset panel has an elongation of from about 100% to about 700% in the length direction at 100 N load. In certain embodiments, the gusset panel has an elongation from about 100% to about 700% in the width direction at 100 N load.

In some embodiments, the level of elongation of gusset panel 20 in the length or width direction can be modified, for example, by varying the types of yarns or stitch patterns used to make the gusset panel 20. In some embodiments, the level of elongation of the gusset panel can be modified, for example, by varying the types of yarns or stitch patterns used to make the seams attaching gusset panel 20 to the front body panel and the back body panel.

The fabric of the gusset panel 20 has recovery such that it returns to its original shape after being stretched. After repeated uses, the gusset panel will still generally lay flat against the wearer's body. The fabric recovery is tested after the third extension-load cycle of test method ASTM D4964-1996(2008), described above. Immediately after the third cycle, the fabric is removed from the loop and allowed to relax for 60 seconds. The length of the loop is measured after relaxing for 60 seconds. The percentage recovery of the fabric is calculated as: the original length divided by the length after the third cycle (including the 60 second rest), then multiplied by 100. In certain embodiments, the gusset panel fabric has a recovery of from about 80% to about 100% after the three extension-load cycles. In certain embodiments, the gusset panel 20 comprises a knit fabric. In certain embodiments, the gusset panel comprises a fabric made on a seamless knitting machine. In certain embodiments, the gusset panel comprises a hosiery fabric. The hosiery fabric can be made through any method known in the art, including circular knitting. Hosiery fabric can be produced using hosiery yarn. In certain embodiments, the weight of the fabric is from about 20 grams per square meter (gsm) to about 500 gsm. In certain embodiments, the fabric is 100 gsm. In certain embodiments, the gusset panel comprises a warp knit fabric. In certain embodiments, the gusset panel comprises a tube elastic. In certain embodiments, the gusset panel comprises a jersey knit fabric. In certain embodiments, the gusset panel comprises nylon. In certain embodiments, the gusset panel comprises spandex. In certain embodiments, the gusset panel comprises a blend of fiber types. In certain embodiments, the gusset panel comprises a nylon and spandex blend. In an embodiment, the gusset panel comprises 80% nylon and 20% spandex. In certain embodiments, the gusset panel comprises a non-woven material. In certain embodiments, the gusset panel comprises a polymer film.

Figure 5:
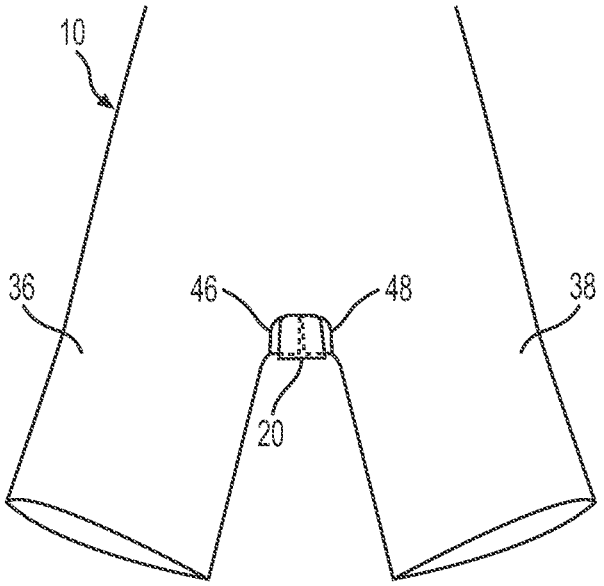
FIG. 5 is a front view of an undergarment embodiment having a gusset panel, a left side cover panel, and a right side cover panel.
Figure 6:
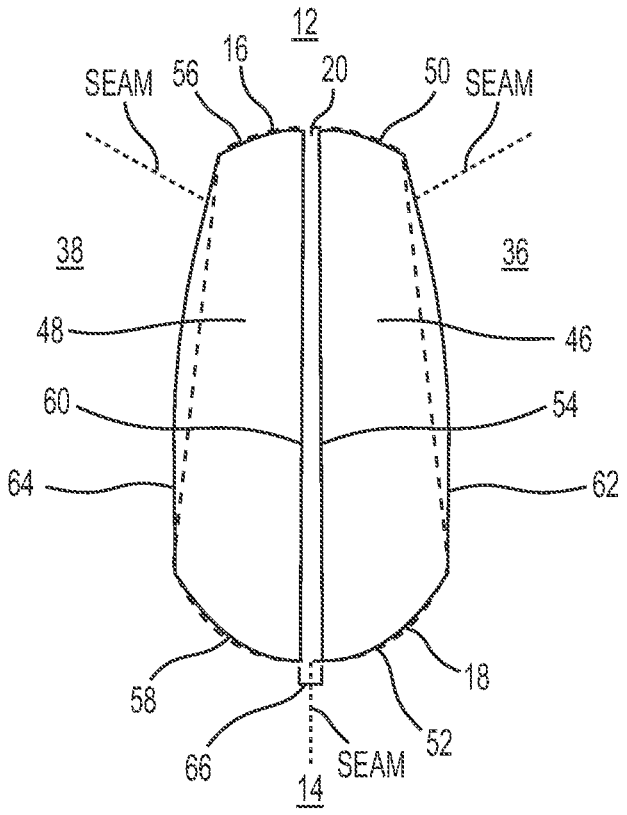
FIG. 6 is an interior (top down) view of the undergarment embodiment of FIG. 5, having a gusset panel, a left leg portion, a right leg portion, a left side cover panel, and a right side cover panel.
Figure 7:
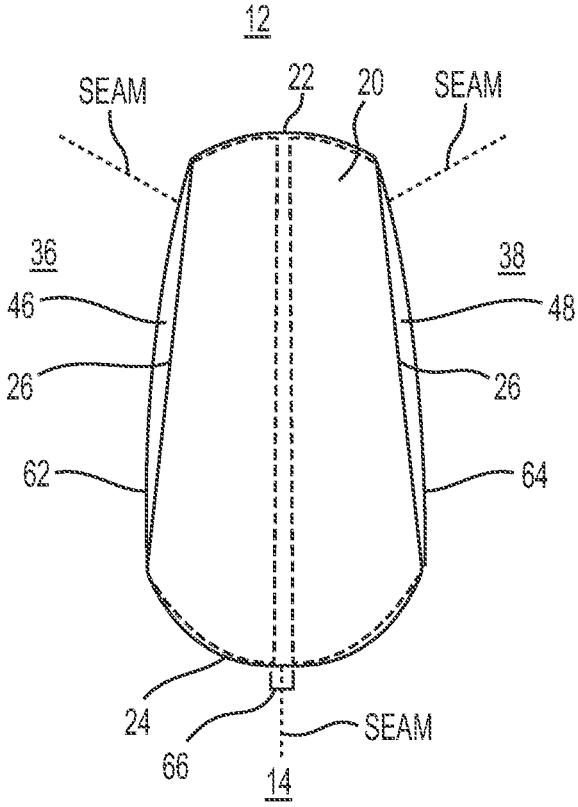
FIG. 7 is an exterior (bottom up) view of the undergarment embodiment of FIGS. 5 and 6.

Some embodiments can include cover panels that extend inward from the front body panel, the back body panel, and/or the leg portions to narrow the access space, overlapping the gusset panel and reducing exposure to provide the wearer with added modesty. FIG. 5 illustrates an embodiment of a garment having a right leg portion 36, a left leg portion 38, a right side cover panel 46, a left side cover panel 48, and a gusset panel 20. FIGS. 6 and 7 illustrate interior (top down) and exterior (bottom up) views, respectively, of the crotch region of the garment of FIG. 5. The dotted lines in FIG. 6 indicate the positioning of the gusset panel 20 beneath the cover panels 46, 48, whereas the dotted lines in FIG. 7 indicate the positioning of the cover panels 46, 48 behind the gusset panel 20. The right side cover panel 46 and the left side cover panel 48 extend inward from leg portions 36, 38 toward access space 66. The access space 66 is defined by the right inside access edge 54 of the right side cover panel 46 and the left inside access edge 60 of the left side cover panel 48. The right side cover panel 46 and left side cover panel 48 are configured to contact or be in close proximity to the wearer's body. The gusset panel 20 is located on the exterior of the garment, but still able to contact the body through the access space 66. In certain embodiments, the left inside access edge 60 and the right inside access edge 54 are directly adjacent. In other embodiments, the left inside access edge 60 and the right inside access edge 54 are spaced apart. In some embodiments, the width of the access space 60 (as measured between the left inside access edge 60 and the right inside access edge 54 when the garment is not being worn) is less than the width of the gusset panel 20.

Figure 8:
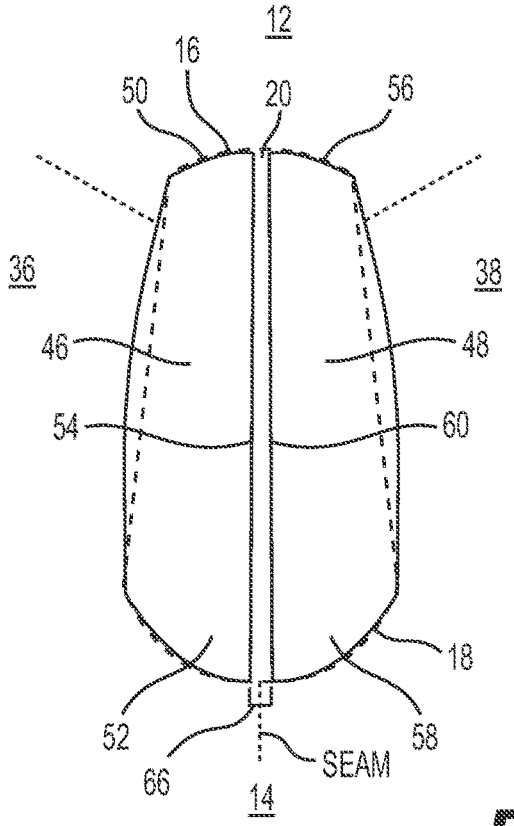
FIG. 8 is an exterior (bottom up) view of an alternative embodiment of undergarment having a gusset panel, a left leg portion, a right leg portion, a left side cover panel, and a right side cover panel.
Figure 9:
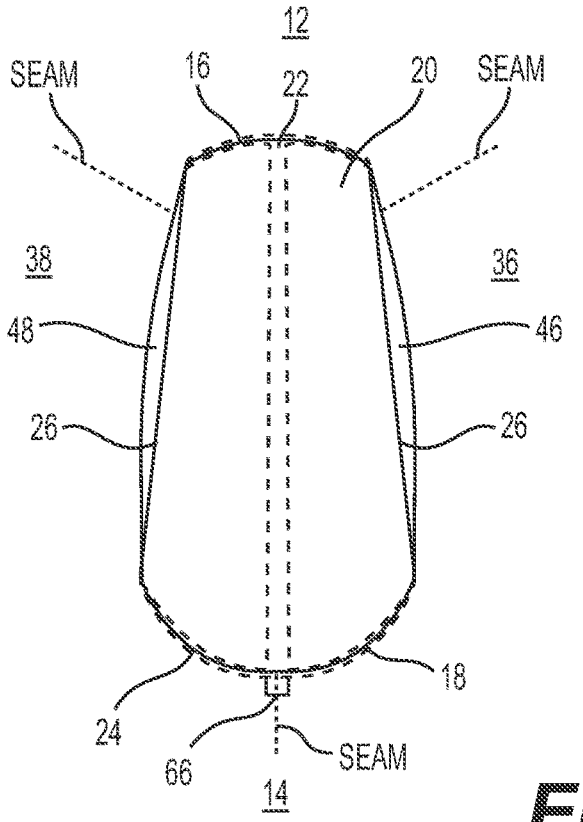
FIG. 9 is an interior (top down) view of the undergarment embodiment of FIG. 8.

FIG. 8 illustrates an exterior view of an alternative embodiment wherein the gusset panel 20 is located on the interior of the garment and is configured to contact the wearer's body, and the right side cover panel 46 and left side cover panel 48 are located on the exterior of the garment. FIG. 9 illustrates an interior view of the garment shown in FIG. 8, showing the gusset panel 20, the right side cover panel 46, and the left side cover panel 48.

Side cover panels 46, 48 are attached to the crotch region of the garment by, for example, stitching, bonding, or any other methods of attachment known in the art. Referring back to FIG. 6, the right side cover panel 46 has a right front cover panel edge 50, a right back cover panel edge 52, a right inside access edge 54, and a right outside cover panel edge 62. The left side cover panel 48 has a left front cover panel edge 56, a left back cover panel edge 58, a left inside access edge 60, and a left outside cover panel edge 64. The right front cover panel edge 50 and the left front cover panel edge 56 are attached to the front body panel lower edge 16, and the right back cover panel edge 52 and the left back cover panel edge 58 are attached to the back body panel lower edge 18. The right and left outside cover panel edges 62, 64 can be stitched or bonded to the front panel 12, the back panel 14 and/or the leg portions 36, 38. For embodiments with leg portions 36, 38 that are continuous with the front and back body panels 12, 14, the attachments of the cover panels 46, 48 in the crotch region of the garment occurs in a transition zone where the leg portions 36, 38 begin. In some embodiments, one or more sides of the cover panels may be continuously formed with the front body panel, the back body panel, and/or the leg portions of the garment.

Figure 10:
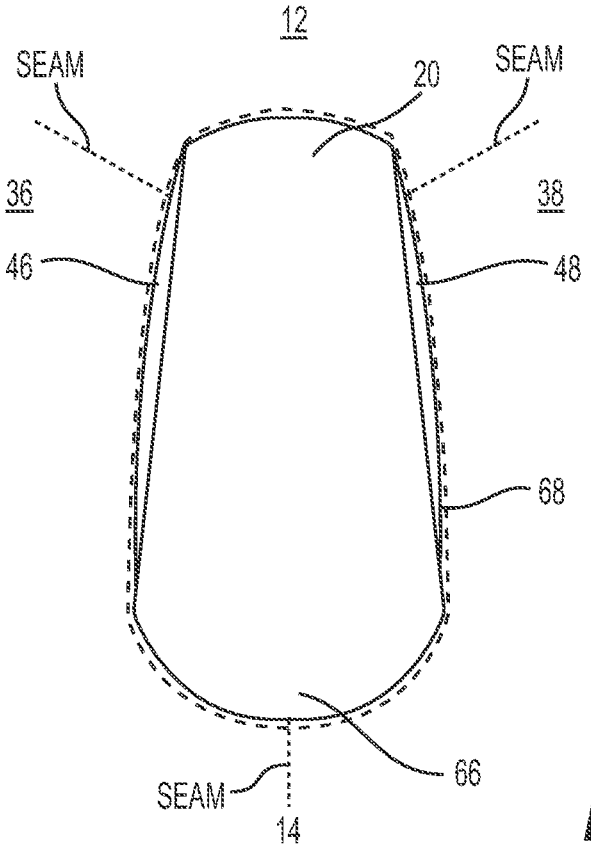
FIG. 10 is an exterior view of an undergarment embodiment, wherein the gusset panel, the left side cover panel and the right side cover panel are attached to the garment with a continuous seam.

As illustrated in FIG. 10, the gusset panel 20, right side cover panel 46, and left side cover panel 48 may all be connected to the front body panel 12, the back body panel 14, and the leg portions with one continuous seam 68. The seam 68 can be positioned on the inside or on the outside of the garment. The seam 68 is attached to the front, back and outside edges of the cover panels 46, 48, but only to the front and back edges of the gusset panel 20 (leaving the lateral edges 26 of the gusset panel 20 free). In certain embodiments, the seam 68 attaching the right and left side cover panels 46, 48 and the gusset panel 20 to the garment can be formed using an overlock stitch. The overlock stitch can be, for example, a three-thread overlock stitch or a four-thread overlock stitch. The width of the stitches can be from about 4 millimeters to about 5 millimeters. In certain embodiments, the seam 68 has from about 17 to about 24 stitches per inch. Any thread known in the art for sewing stretchable fabrics can be used for the seam 68. Preferred thread types include Coats SeamSoft or A&E Anesoft. In certain embodiments, tex 24 yarn is used. In certain embodiments, tex 18 yarn is used. In an embodiment, the seam 68 is an overlock stitch, where tex 24 yarn is used for the needles and tex 18 yarn is used for the loopers. In other embodiments, the side cover panels 46, 48 and the gusset panel 20 are attached to the front body panel and the back body panel by bonding. In certain embodiments, the gusset panel attachment is continuously knitted to one or both of the front body panel and the back body panel.

Figure 11:
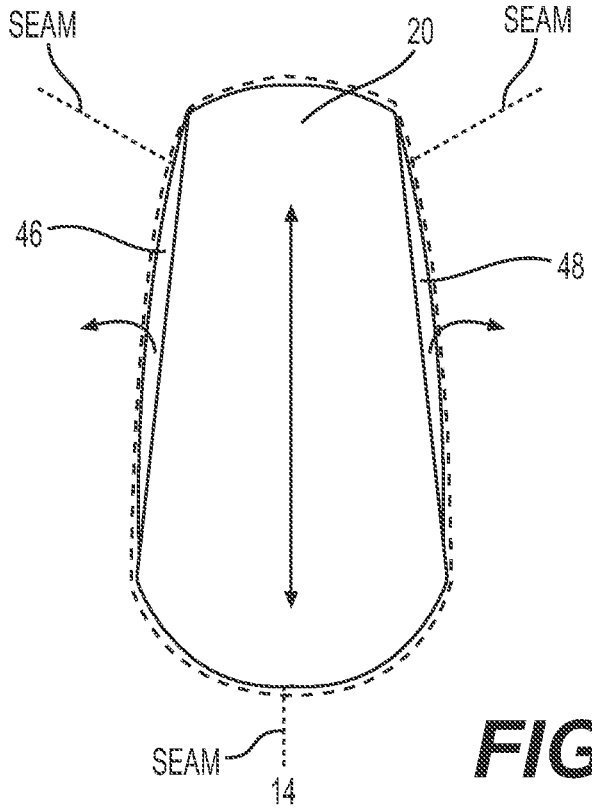
FIG. 11 is a view of the preferred direction of elongation of the gusset panel, left side cover panel, and right side cover panel.

In some embodiments, the fabric used to form the gusset panel 20 has equal elongation values in the length direction and the width direction (wherein width is measured from left to right and length is perpendicular to width). Likewise, the fabric used to form the cover panels 46, 48 can have equal elongation values in the length direction and the width direction. In other embodiments, these components may have greater elongation in one direction as compared to the other. FIG. 11 illustrates preferred directions of elongation for the gusset panel 20 and the right side cover panel 46 and the left side cover panel 48 in one embodiment. In this embodiment, the elongation of the gusset panel 20 is greater in the length direction than in the width direction, whereas the elongation of each cover panel 46, 48 is greater in the width direction than in the length direction.

Further disclosed herein are methods of making an undergarment having a gusset panel. Methods include forming a front body panel, a back body panel, a left leg portion, and a right leg portion. A front edge of a gusset panel is fixedly attached to a lower edge of a front body panel, and a back edge of the gusset panel is fixedly attached to a lower edge of a back body panel. At least a portion of a lateral gusset edge is left unattached to any part of the garment. The gusset panel can be fixedly attached to the front body panel and back body panel by a seam, by bonding, or by other methods. In other embodiments, methods of making the undergarment include seamlessly attaching a gusset panel to a front body panel and a back body panel. Left and right leg portions are seamlessly attached to the front and back body panels. At least a portion of a lateral gusset edge is left unattached to any part of the garment.

The method can further include fixedly attaching a left side cover panel to the front body panel, the back body panel, and the left leg portion such that the left side cover panel is overlapped by the left lateral gusset panel edge, and fixedly attaching a right side cover panel to the front body panel, the back body panel, and the right leg portion such that the right side cover panel is overlapped by the right lateral gusset panel edge. For example, a continuous seam can be used to fixedly attach the left side cover panel, the right side cover panel, the front gusset panel edge, and the back gusset panel edge. The continuous seam can extend around the cover panels as described above (i.e., it can attach the garment to the left front cover panel edge, the left outside cover panel edge, the left back cover panel edge, the right back cover panel edge, the right outside cover panel edge, and the right front cover panel edge). The same continuous seam can be used to attach the front gusset panel edge to the front body panel lower edge, the left front cover panel edge, and the right front cover panel edge, and to attach the back gusset panel edge to the back body panel lower edge, the left back cover panel edge, and the right back cover panel edge.

The invention claimed is:

1. A garment comprising:

a front body panel, a back body panel, a left leg portion extending inferiorly from the front and back body panels, a right leg portion extending inferiorly from the front and back body panels, a gusset panel comprising a front gusset panel edge attached to the front body panel, a back gusset panel edge attached to the back body panel, a free left lateral gusset panel edge unattached to the front body panel, the back body panel, or the left leg portion, and a free right lateral gusset panel edge unattached to the front body panel, the back body panel, or the right leg portion, a left side cover panel extending between the front and back body panels through a crotch region of the garment, a right side cover panel extending between the front and back body panels through the crotch region of the garment, the left side cover panel having a left front cover panel edge attached to the front body panel and the left side cover panel having a left back cover panel edge attached to the back body panel, the right side cover panel having a right front cover panel edge attached to the front body panel and the right side cover panel having a right back cover panel edge attached to the back body panel, wherein the left and right side cover panels at least partially overlap the gusset panel, wherein the free left lateral gusset panel edge and the left leg portion at least partially define a left access space positioned between the gusset panel and the left leg portion, wherein the free right lateral gusset panel edge and the right leg portion at least partially define a right access space positioned between the gusset panel and the right leg portion, and wherein lateral movement of the gusset panel widens the left access space or the right access space.

2. The garment of claim 1, wherein the front and back gusset panel edges are attached to the front body panel and the back body panel by a continuous seam that contacts the front body panel, the left leg portion, the back body panel, and the right leg portion, thereby encircling the gusset panel.

3. The garment of claim 1, wherein the gusset panel comprises a tubular fabric.

4. The garment of claim 1, wherein the gusset panel has an elongation of 100-700% in a length direction.

5. The garment of claim 1, wherein the gusset panel has an elongation of 100-700% in a width direction.

6. The garment of claim 1, wherein an elongation of the gusset panel in a length direction is greater than an elongation of the gusset panel in a width direction.

7. The garment of claim 1, wherein an elongation of the gusset panel in a length direction is equal to an elongation of the gusset panel in a width direction.

8. The garment of claim 1, wherein the back gusset panel edge is wider than the front gusset panel edge.

9. The garment of claim 1, wherein the left side cover panel comprises a free left inside access edge and the right side cover panel comprises a free left inside access edge, and wherein the left inside access edge and the right inside access edge further define a central access space.

10. The garment of claim 9, wherein the gusset panel is positioned exteriorly to the left side cover panel and the right side cover panel.

11. The garment of claim 9, wherein the left side cover panel is attached to the left leg portion and overlaps the free left lateral gusset panel edge, and the right side cover panel is attached to the right leg portion and overlaps the free right lateral gusset panel edge.

12. The garment of claim 11, wherein the left side cover panel is attached to the front body panel, the back body panel, and the left leg portion, and wherein the right side cover panel is attached to the front body panel, the back body panel, and the right leg portion.

13. The garment of claim 12, wherein the gusset panel, the left side cover panel, and the right side cover panel are fixedly attached to the front body panel and the back body panel by a continuous seam that contacts the front body panel, the left leg portion, the back body panel, and the right leg portion.

14. The garment of claim 13, wherein the continuous seam comprises an overlock stitch.

15. The garment of claim 9, wherein the elongation of each cover panel in the width direction is greater than the elongation of each cover panel in the length direction.

16. The garment of claim 9, wherein the elongation of each cover panel in the width direction is equal to the elongation of each cover panel in the length direction.

17. The garment of claim 1, wherein the gusset panel has a higher elasticity than the front body panel and the back body panel.

18. A method of making a garment, the method comprising:

providing a front body panel, a back body panel, a left leg portion extending inferiorly from the front and back body panels, a right leg portion extending inferiorly from the front and back body panels, a gusset panel, a left side cover panel extending between the front and back body panels through a crotch region of the garment, and a right side cover panel extending between the front and back body panels through the crotch region of the garment;

the gusset panel comprising a free left lateral gusset panel edge and a free right lateral gusset panel edge, fixedly attaching a front gusset panel edge of the gusset panel to a lower edge of the front body panel;

fixedly attaching a back gusset panel edge of the gusset panel to a lower edge of the back body panel; and leaving at least a portion of the free left and right lateral gusset panel edges unattached to any part of the garment;

the left side cover panel having a left front cover panel edge attached to the front body panel and the left side cover panel having a left back cover panel edge attached to the back body panel, the right side cover panel having a right front cover panel edge attached to the front body panel and the right side cover panel having a right back cover panel edge attached to the back body panel, wherein the left and right side cover panels at least partially overlap the gusset panel, wherein the free left lateral gusset panel edge and the left leg portion at least partially define a left access space positioned between the gusset panel and the left leg portion, wherein the free right lateral gusset panel edge and the right leg portion at least partially define a right access space positioned between the gusset panel and the right leg portion, and wherein lateral movement of the gusset panel widens the left access space or the right access space.

19. The method of claim 18, wherein the gusset panel has a higher elasticity than at least one of the front body panel, the back body panel, the left leg portion, or the right leg portion.

20. The method of claim 18, further comprising fixedly attaching the left side cover panel to the front body panel, the back body panel, and the left leg portion such that the left side cover panel is overlapped by the free left lateral gusset panel edge, and fixedly attaching the right side cover panel to the front body panel, the back body panel, and the right leg portion such that the right side cover panel is overlapped by the free right lateral gusset panel edge.

21. The method of claim 20, wherein a continuous seam is used to fixedly attach the left side cover panel, the right side cover panel, the front gusset panel edge, and the back gusset panel edge.

22. The method of claim 20, further comprising stitching a continuous seam to attach the garment to the left front cover panel edge, a left outside cover panel edge, the left back cover panel edge, the right back cover panel edge, a right outside cover panel edge, and the right front cover panel edge.

23. The method of claim 22, wherein the continuous seam attaches the front gusset panel edge to the front body panel lower edge, the left front cover panel edge, and the right front cover panel edge and wherein the continuous seam attaches the back gusset panel edge to the back body panel lower edge, the left back cover panel edge, and the right back cover panel edge.

* * * * *